US005249794A

United States Patent [19]

Plent et al.

[11] Patent Number: 5,249,794

[45] Date of Patent: Oct. 5, 1993

[54] FEED DEVICE FOR A SORTING MACHINE FOR SORTING FLAT OBJECTS SUCH AS POSTAL ITEMS

[75] Inventors: Christian Plent, Bourg les Valence; Christian Laumond, Chabeuil; Bernard Constant, Beaumont les Valence; Michel Divoux, Bourg de Peage; Pierre Campagnolle, Beaumont les Valence, all of France

[73] Assignee: Compagnie Generale d'Automatisme CGA-HBS, Bretigny sur Orge, France

[21] Appl. No.: 901,185

[22] Filed: Jun. 19, 1992

[30] Foreign Application Priority Data

Jun. 21, 1991 [FR] France ..... 91 07658

[51] Int. Cl.[5] ..... B65H 5/02

[52] U.S. Cl. ..... 271/225; 271/227; 271/235; 271/246; 271/176; 271/184; 271/270

[58] Field of Search ..... 271/184, 176, 225, 227, 271/235, 239, 245, 246, 270

[56] References Cited

U.S. PATENT DOCUMENTS 2,941,654 6/1960 Falconer .
3,951,257 4/1976 Storace et al. .
3,952,874 4/1976 Owen ..... 271/225 X
4,757,903 7/1988 Edin ..... 271/184 X
5,004,222 4/1991 Dobashi ..... 271/184 X

FOREIGN PATENT DOCUMENTS 1220650 6/1966 Fed. Rep. of Germany .
1565292 3/1969 France .
311992 12/1955 Switzerland .
1093038 11/1967 United Kingdom .

*Primary Examiner*—Richard A. Schacher
*Attorney, Agent, or Firm*—Sughrue, Mion, Zinn, Macpeak & Seas

[57] ABSTRACT

The present invention relates to a feed device for feeding a sorting machine for sorting flat objects and comprising at least one input feeder for the objects and pockets to which the objects are fed vertically for transport, the feed device allowing the objects to be fed one by one from the input feeder towards a vertical pocket. A conveyor module comprises at least two stop gates spaced by a distance greater than the maximum length of the objects. An accelerator module is located between the conveyor module and a vertical transfer device and comprises a downstream stop gate. The vertical ejection device is formed by an injecting module. These modules are provided with continuously operating positive entrainment devices and the stop gates control the movements of the objects in response to detectors located in the path of the objects.

14 Claims, 11 Drawing Sheets

FEED DEVICE FOR A SORTING MACHINE FOR SORTING FLAT OBJECTS SUCH AS POSTAL ITEMS

The present invention relates to a feed device for feeding a sorting machine for sorting flat objects and comprising at least one input feeder for input of the objects one by one and a plurality of pockets to which the objects are fed vertically for transport and discharge into output containers, the feed device allowing the objects to be conveyed one by one from the input feeder towards a vertical pocket and comprising a conveyor substantially perpendicular to the path of the pockets and associated with a transfer device for transferring the objects vertically downwards into a pocket.

BACKGROUND OF THE INVENTION

Such a sorting machine for sorting flat objects, in particular postal items or "letters", comprises:

- a sorting carousel having a plurality of pockets moving along guide rails,
- one or more input feeders to which the objects are fed one by one, manually or automatically, after determining the post (ZIP) code, to be fed into the pockets by means of a feed device, and
- a plurality of outputs where the letters for the same destination are discharged and stacked in the same tray or an equivalent.

Such a sorting machine is described in French patent FR 2 454 338, where the feed of the objects is effected by horizontal conveyor belts alternating with wheels which can be raised by an actuator to direct the objects in the travel direction of the pocket path to insert the objects into a channel which can be pivoted by a motor between a substantially horizontal position in which it can receive the object to be fed, and a substantially vertical position in which it can discharge the object into the corresponding pocket. The channel includes an output chute closed by a pivoting gate controlled by a lever operated by an operating device.

The invention provides a feed device with higher performance, which allows a particularly high rate of operation, while being simple, compact and adapted to a large range of mail.

The feed device is intended in particular for fitting in a sorting machine including a carousel, fed by a plurality of input feeders, serving up to 180 sort destinations and capable of a minimum flow rate of six objects per second. In order to limit the speed of the carousel, the objects are transported in pockets along a direction normal to their surface. Since the pitch between carousel pockets is around 90 mm, this flow of objects is obtained with a minimum transfer speed of 0.54 m/s.

The maximum number of input feeders is such that it remains compatible with the minimum flow of six objects per second. Taking into account the flows which can be attained by the three types of input feeder that are envisaged (with manual presentation and coding, around 0.7 objects/second; with automatic presentation and manual coding, around 1.1 objects/second; with manual presentation and optical reading, around 1.8 objects/second), feeders can be provided in number and of types such that their total flow rate does not exceed the flow rate of the conveyor.

The said sorting machine allows a particularly large range of mail to be processed. By way of example, the area L by h can vary from 145 mm by 250 mm to 225 mm by 353 mm, the thickness being from 0.5 mm to 20 mm and the weight from 10 g to 500 g. Moreover the feed device should suit any kind of mail, regardless of its rigidity or flexibility, whatever its wrapping (rigid card or flexible plastic).

SUMMARY OF THE INVENTION

To this end, according to the invention, the conveyor module comprises at least two stop gates spaced by a distance greater than the maximum length of the objects, an accelerator module is located between the conveyor module and the vertical downwards transfer device and comprises a downstream stop gate, the vertical downwards transfer device is formed by an injecting module, these modules being provided with continuously operating positive entrainment devices and the stop gates being retractable and controlling the movements of the objects in response to detectors located in the path of the objects.

Preferably the three modules are in line and comprise a backing surface for objects inclined relative to the vertical plane.

In a preferred embodiment, each stop gate is formed by a retractable finger acting as a stop. This finger passes through the backing surface in the operative position and is fixed to a lever pivoting about a horizontal axis. The lever is actuated by an electromagnet.

The accelerator and conveyor modules preferably comprise a support surface perpendicular to the backing surface.

In a preferred embodiment the backing surface and the support surface of the conveyor module are provided with continuously operating conveyor belts.

Moreover, the conveyor module is provided with a freely rotating pressure wheel near to each stop gate and mounted at the end of a lever pivoting about an axis perpendicular to the support surface and biased by a spring.

In a preferred embodiment, the accelerator module includes transfer means and accelerating means pivoting between a rest position and an active position in which the object is held between these two means, which are rotated continuously.

The transfer means is preferably formed by at least one pair of pulleys mounted respectively on two shafts parallel to the backing surface, at least one endless belt being fitted on the pulleys.

In a preferred embodiment, the accelerating means is formed by at least one endless belt in tension over at least one pair of pulleys mounted on two shafts which are fixed together and of which one is pivoted and actuated by an electromagnet.

Preferably:

- the injecting module comprises transfer means acting downwards, tangentially with respect to the backing surface, pressure means pivoting about a horizontal axis and a retractable blocking shutter forming a support surface perpendicular to the backing surface;
- the downwardly acting transfer means is formed by a continuously driven roller rotating about a horizontal axis; and
- the pressure means is formed by at least two wheels rotating freely about a horizontal shaft mounted on a frame which pivots about a horizontal axis and is actuated by an electromagnet.

The invention also relates to a method of operating the feed device, according to which photoelectric sensors are located in the path of the objects in order to control the movements thereof, and:

the stop gates of the conveyor module are normally open and are closed when a letter arrives, if a letter is present and arrested at the following stop gate; and the stop gate of the accelerator module is normally closed and is opened after arrival of a letter if no letter is detected in the injecting module.

BRIEF DESCRIPTION OF THE DRAWINGS

An embodiment of the invention is described by way of example with reference to the accompanying drawings, in which.

DETAILED DESCRIPTION

Figure 1:
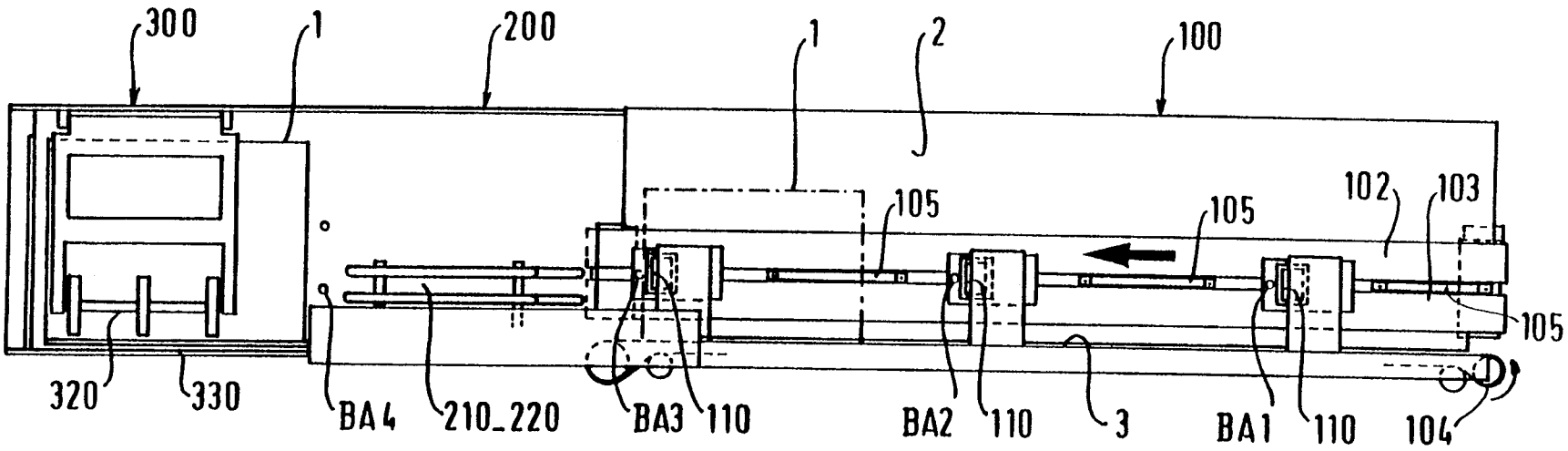
FIG. 1 is a front view of the device.

As can be seen in FIG. 1, the feed device is formed by a conveyor module 100, an accelerator module 200 and an injecting module 300, disposed in a line.

The assembly of these modules has a backing surface 2 inclined relative to the vertical (by around 20°) and the conveyor and accelerator modules include a support surface 3 perpendicular to the backing surface 2. The objects 1 are thus placed with their long edges on the support surface 3 and their surfaces resting against the backing surface 2.

The conveyor module 100 is equipped with three stop gates BA1, BA2 and BA3, while the accelerator module is equipped with one gate BA4. The conveyor module thus allows for buffer storage of three objects 1. The conveyor module 100 is provided with a pressure wheel 110 near to each stop gate.

The conveyor module 100 is provided with two conveyor belts 102, 103 on its backing surface 2 and one conveyor belt 104 on its support surface 3. Upstream of each gate and between the conveyor belts 102, 103 are located flexible blades 105 which reduce the contact pressure of the letter against the belts 102, 103 when the gates BA1, BA2, BA3 are closed.

The accelerator module is provided with transfer and accelerating means 210, 220.

The injecting module is provided with downwardly acting transfer means (not visible), pressure means 320 and a retractable blocking shutter 330.

The positive entrainment means, which are the belts 102, 103, 104, the transfer means 210, the accelerating means 220, and the downwardly acting transfer means of the injecting module are all operated continuously. The movement of the objects 1 is controlled by the stop gates BA1 to BA4 in response to detectors located in the path of the objects 1, as will be seen in more detail below.

Figure 2:
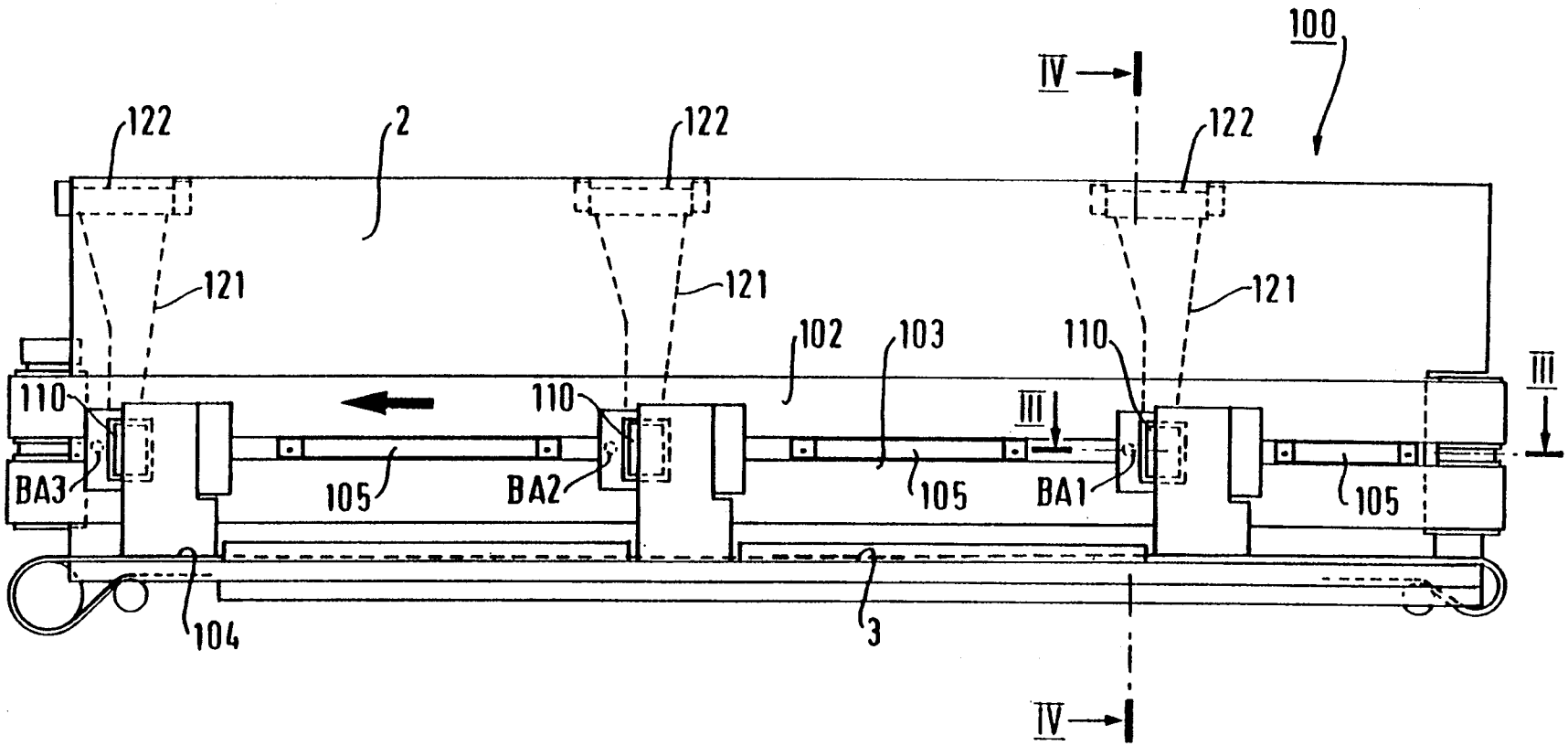
FIG. 2 is a front view of the conveyor module.
Figure 3:
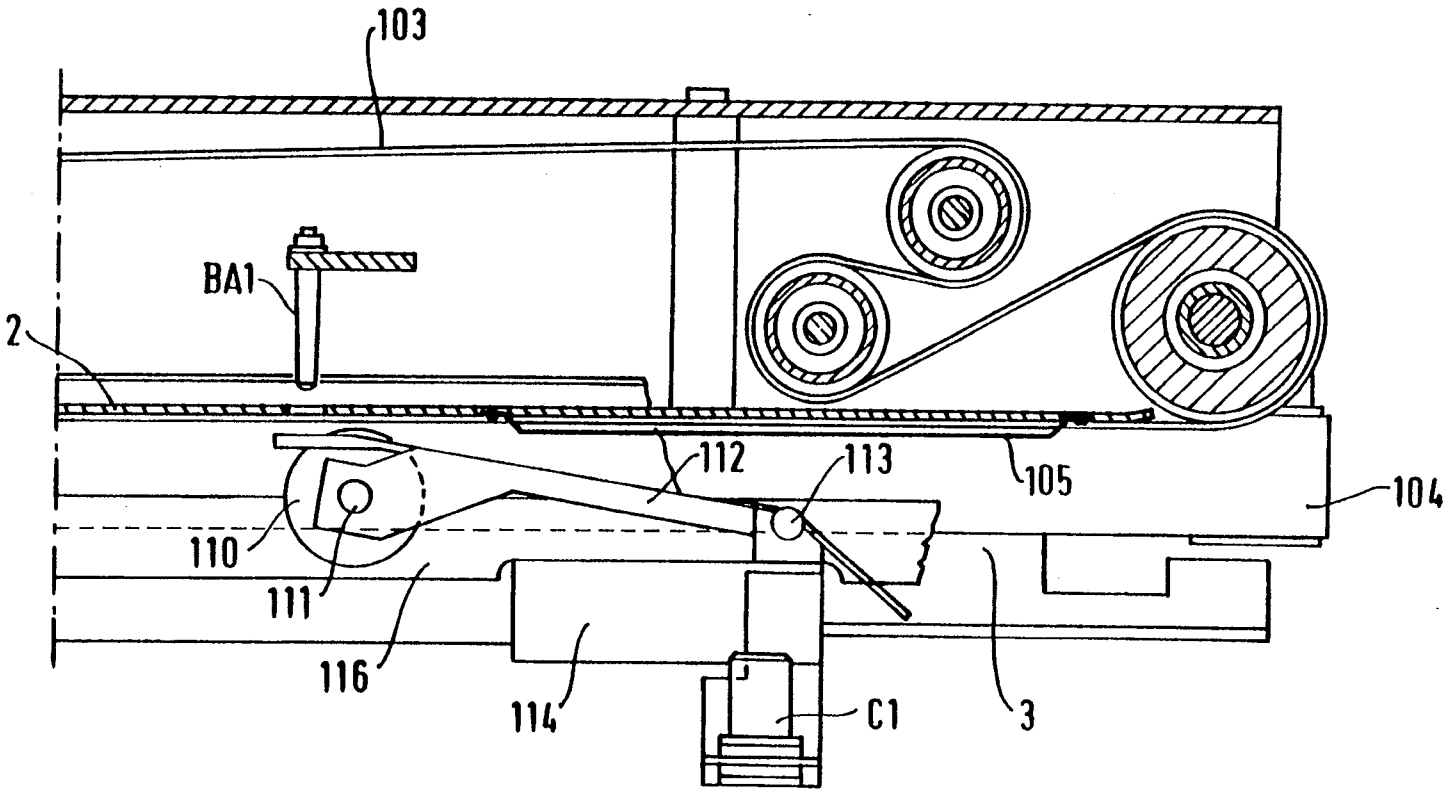
FIG. 3 is a cross-section on the line III—III of FIG. 2.

The conveyor module is now described in more detail with reference to FIGS. 2, 3 and 4.

Each pressure wheel 110 is free to rotate about an axis 111 perpendicular to the support surface 3 and is mounted on an arm 112 pivoting about an axis 113 fixed in a fixed support part 114. Springs 115 bias the lever so that the wheel 110 is pressed against the backing surface 2. The support part 114 also carries a source C1 (not shown in FIG. 4) for a photoelectric cell, associated with a receiver 115 fixed to the backing surface 2.

The front edge of the conveyor belt 104 is covered by a stop strip 116.

Figure 4:
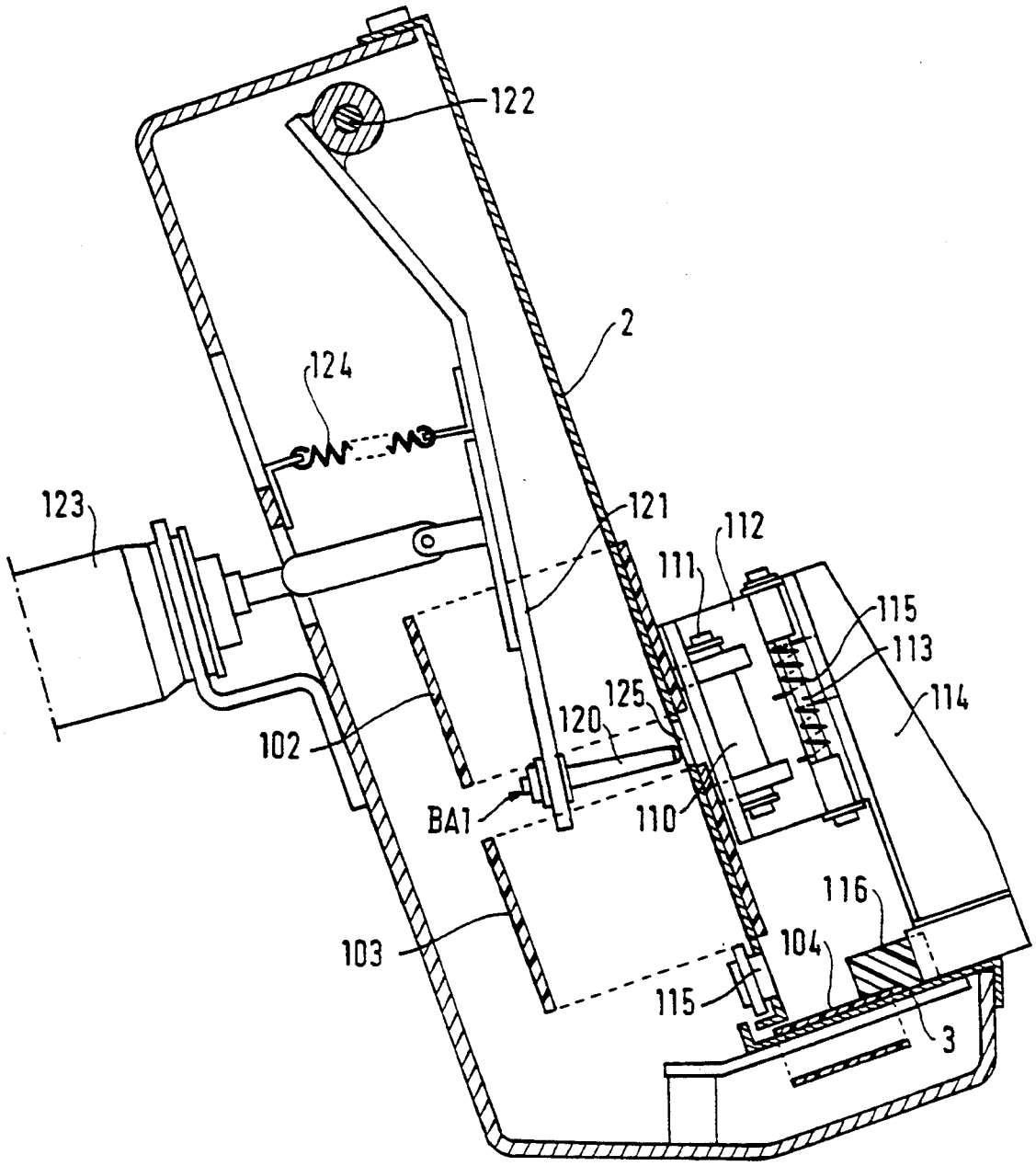
FIG. 4 is a cross-section on the line IV—IV of FIG. 2.

The stop gate BA1 in particular is visible in FIG. 4. The gates BA2 and BA3 are identical.

The stop gate BA1 is formed by an abutment finger 120 fixed on a lever 121 which is arranged to pivot about a horizontal axis 122. The lever 121 is operated by a single-acting electromagnet 123, its return being effected by a spring 124. The stop gate BA1 is shown in retracted position. In its active position, the finger 120 forms an abutment, passing through the opening 125 and repelling the presser wheel 110 by pivoting the arm 112 about the axis 113.

The accelerator module 200 is described below with reference to FIGS. 5, 6 and 7.

Figure 5:
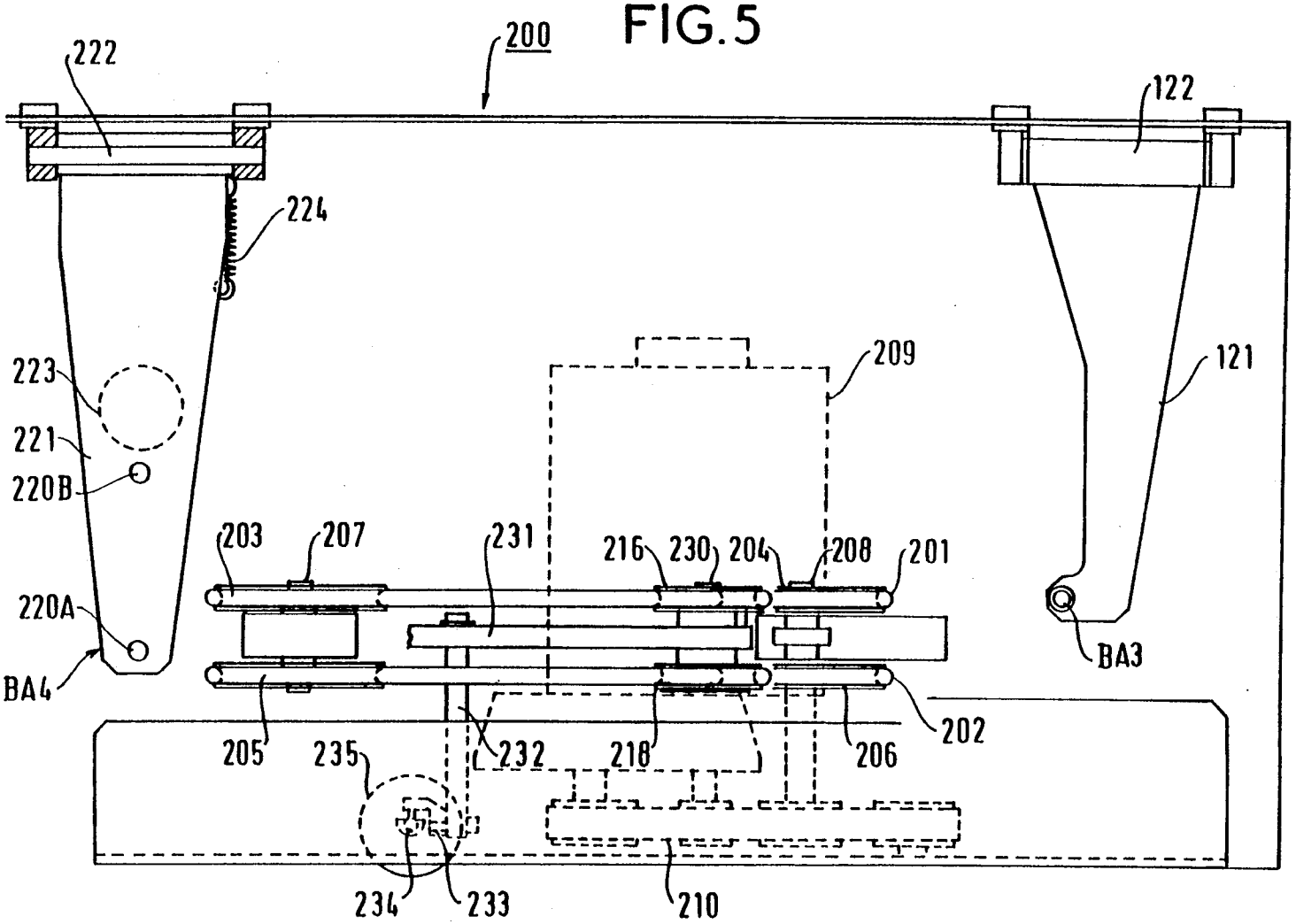
FIG. 5 is a front view of the accelerator module.

FIG. 5 is a front view with the backing and support surfaces 2 and 3 removed for improved visibility.

The module 200 comprises transfer means acting tangentially relative to the backing surface 2 and to accelerating means carried by the support surface 3.

The transfer means comprise two endless belts 201 and 202, in tension over pulleys 203, 204, 205 and 206 mounted in pairs on two shafts 207, 208 parallel to the backing surface 2 and perpendicular to the support surface 3. The shaft 208 is rotated continuously by a motor 209 FIG. 6, through a belt 210. The belts 201 and 202 run tangentially with respect to the backing surface 2 in slots 211, 212.

The accelerating means likewise comprise two endless belts 213, 214 in tension over pulleys 215, 216, 217 and 218 mounted in pairs on two shafts 219, 230 parallel to the backing surface 2 and perpendicular to the support surface 3. The shaft 230 is rotated continuously by the motor 209 though the belt 210.

It should be noted that the same motor 209 can also drive the conveyor belts 102, 103, 104 of the conveyor module 100.

The active pulleys 203 to 206 and 215 to 217 have the same diameters. The drive pulleys have smaller diameters.

Figure 7:
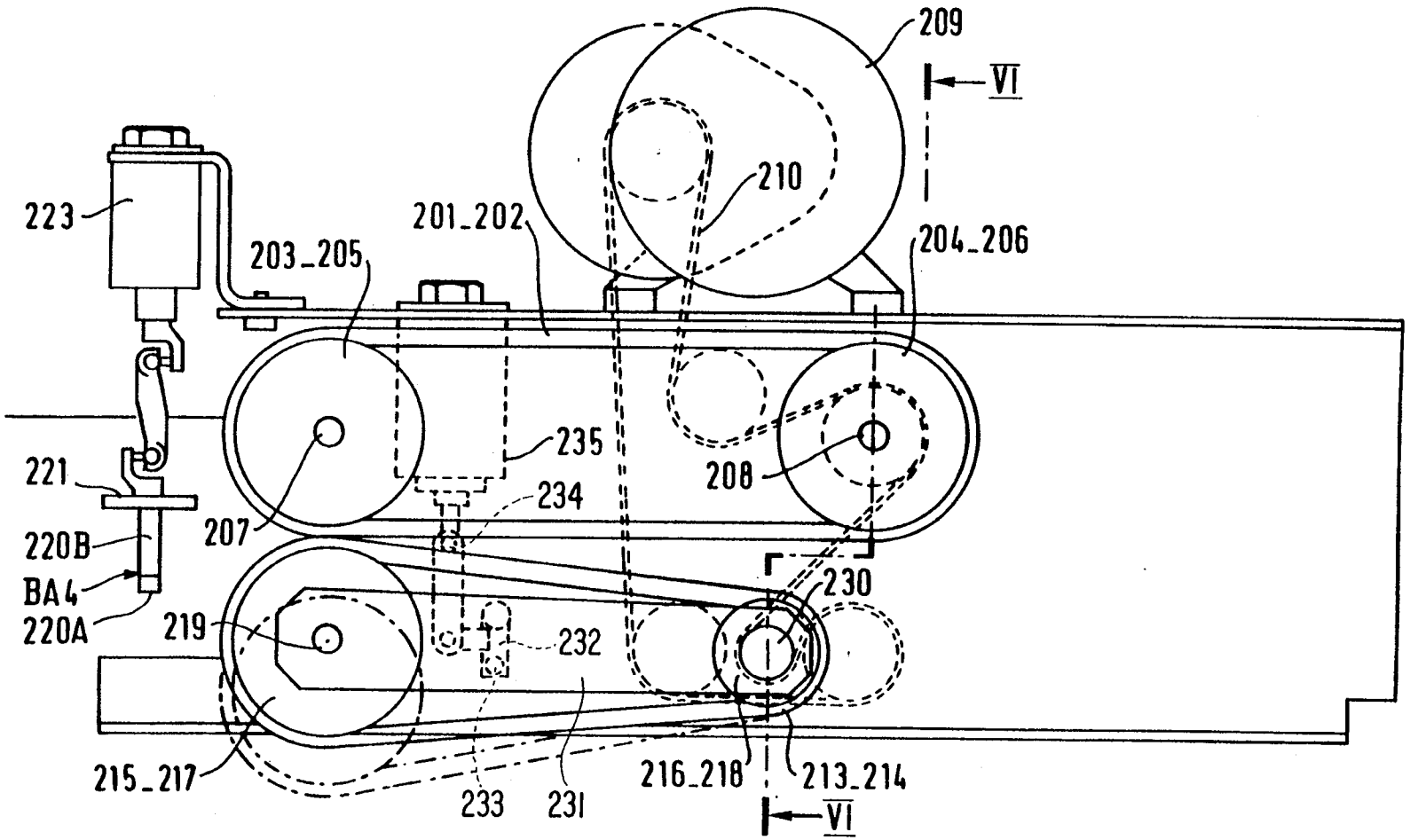
FIG. 7 is a top view of the accelerator module.

The accelerating means is pivoted from an inactive position shown in chain-dotted lines in FIG. 7 to an active position, in which it comes into engagement with the object, which is then accelerated by cooperation of the belts 201, 202 of the transfer means with the belts 213, 214 of the accelerating means, the stop gate BA4 being then retracted.

To do this, the shaft 219 is fixed to the shaft 230 by an arm 231. This arm 231 is moreover positioned by a rod 232 coupled through a rotary joint 233 and a ball joint 234 to an electromagnet 235, which effects the pivoting.

Figure 6:
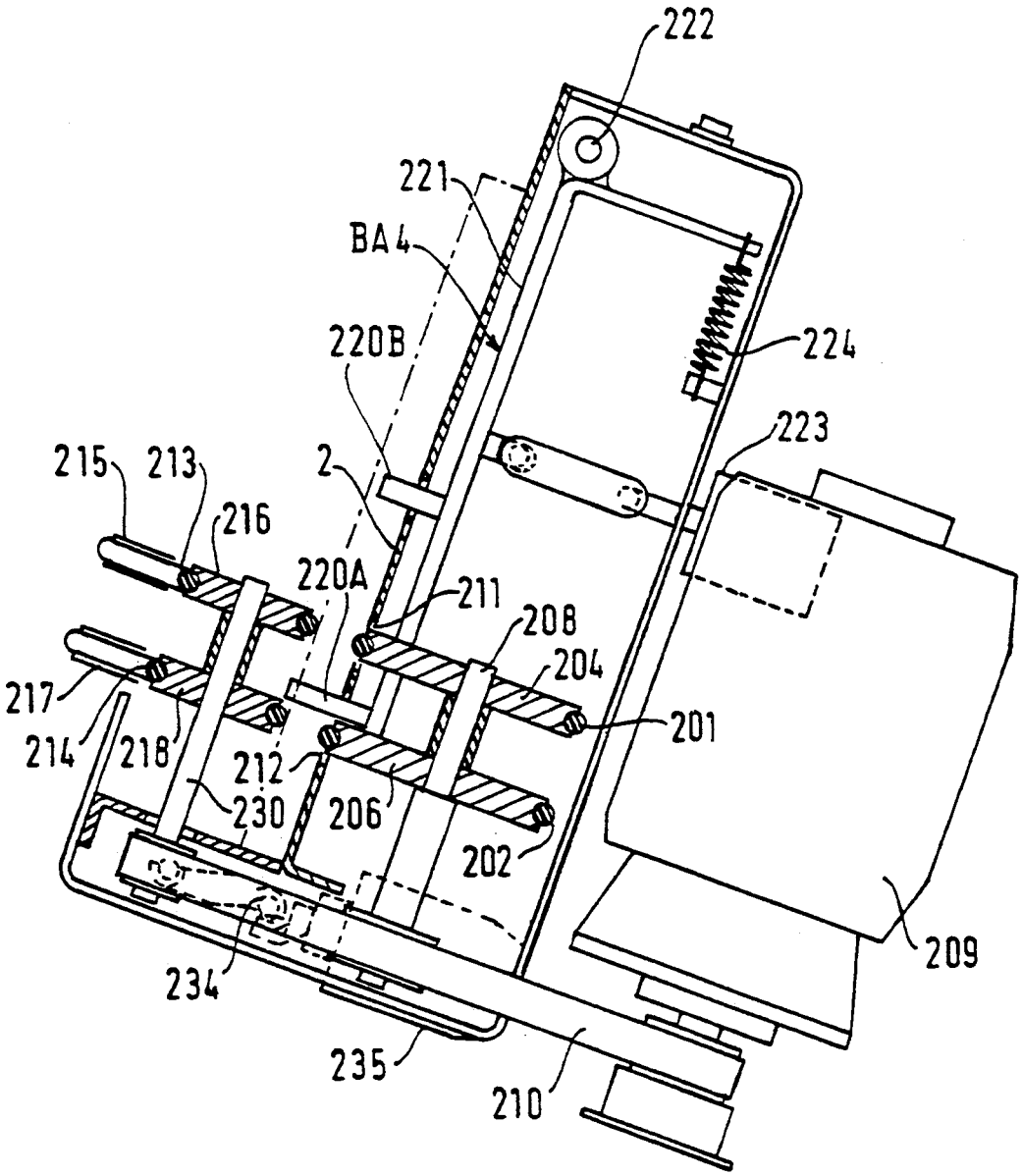
FIG. 6 is a cross-section on the line VI—VI of FIG. 7.

The stop gate BA4, FIG. 6, is formed by two abutment fingers 220A and 220B fixed on a lever 221, which lever is arranged to pivot about a horizontal axis 222. The lever 221 is operated by a single-acting electromagnet 223; its return being effected by a spring 224.

Figure 8:
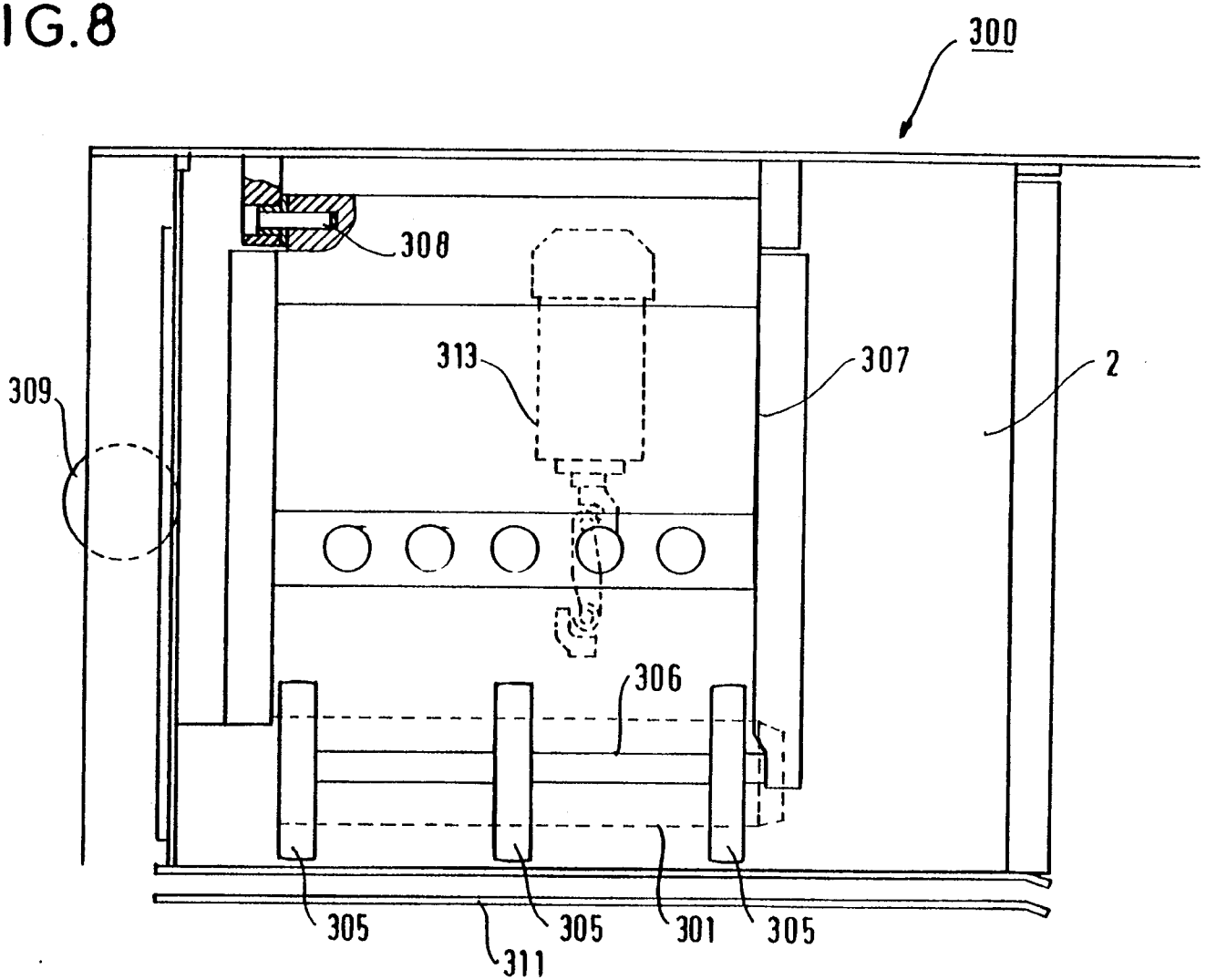
FIG. 8 is a front view of the injecting module.
Figure 9:
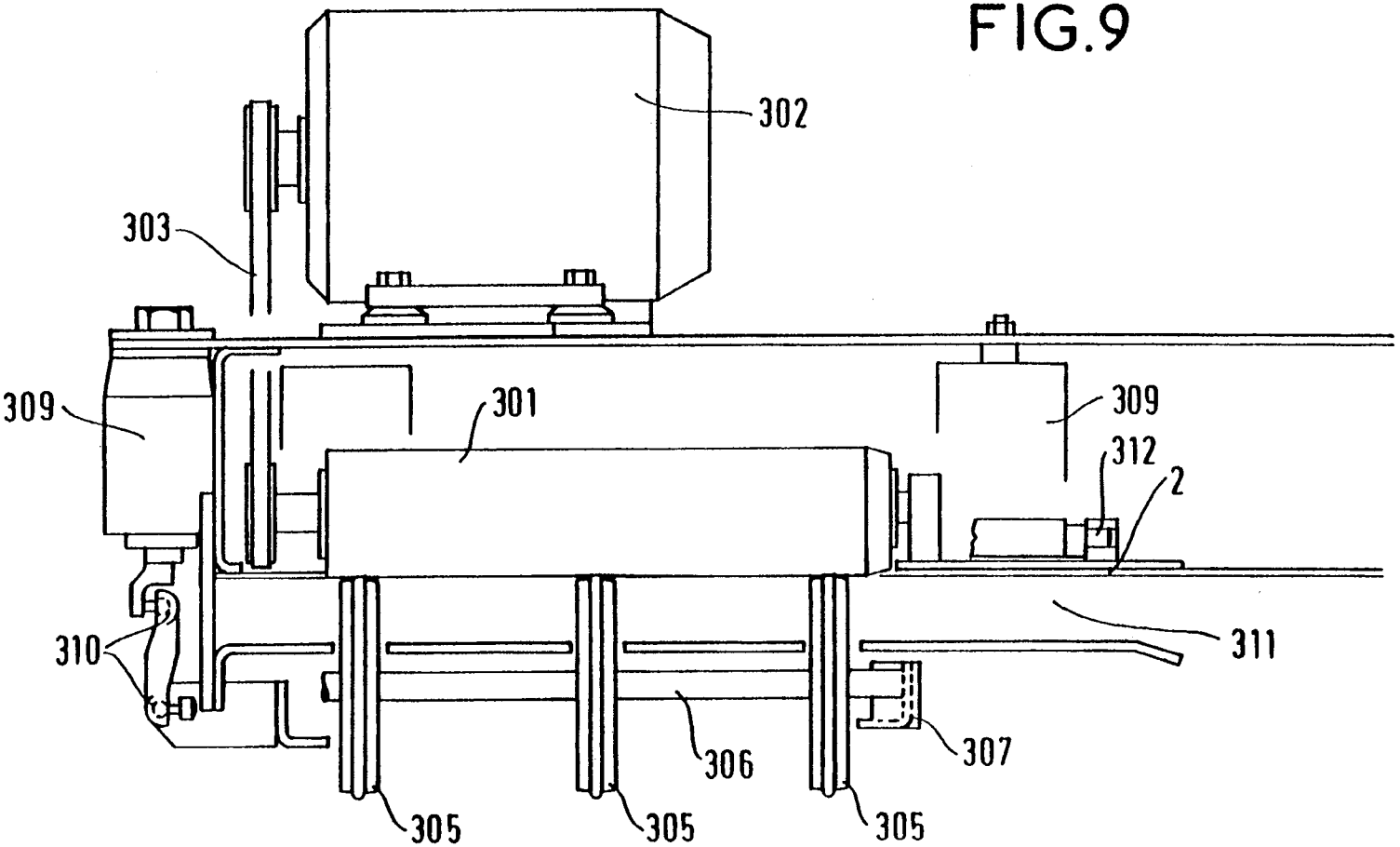
FIG. 9 is a top view of the injecting module.
Figure 10:
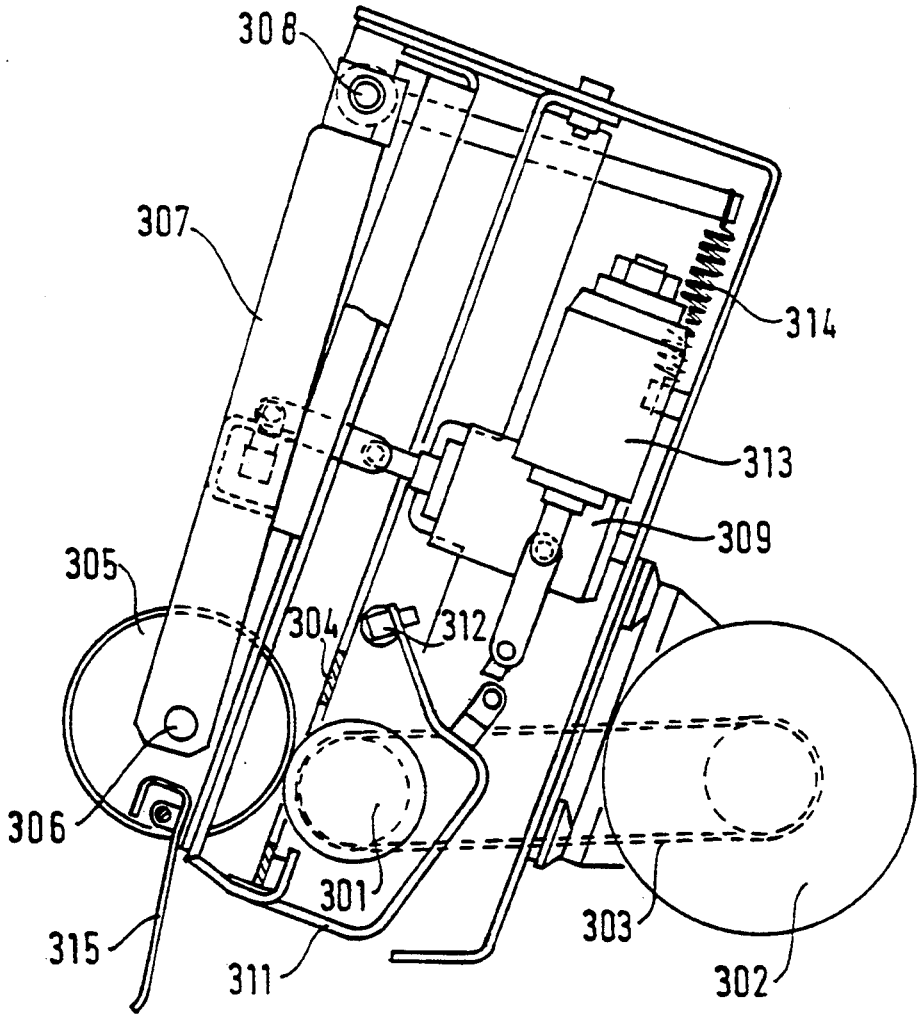
FIG. 10 is a side view of the injecting module.

The injecting module 300 is now described with reference to FIGS. 8, 9 and 10.

This module comprises downwardly acting transfer means, pressure means and a retractable blocking shutter forming a support surface perpendicular to the backing surface 2.

The downwardly acting transfer means is formed by a roller 301 rotated continuously by a motor 302 through a belt 303. The roller 301 is tangential to the backing surface 2 through an opening 304.

The pressure means is formed by three rollers 305 mounted to rotate freely about a common horizontal shaft 306, which is mounted in a frame 307 pivoting about a horizontal axis 308. This frame 307 is actuated by a single acting electromagnet 309 through a double ball joint 310 and is restored by a spring 314.

The blocking shutter has a profiled section 311 hinged about a horizontal axis 312. In its active position, it continues the support surface 3. This shutter is actuated by an electromagnet 313. In its retracted position, it opens up the downwards passage for the letter 1.

The injecting module is moreover provided with a deflector 315 for correctly orientating the objects following a curved path. The deflector is retractable and operates a detector at the end of its stroke to stop the carousel immediately if an object engages it during its descent.

Figure 11:
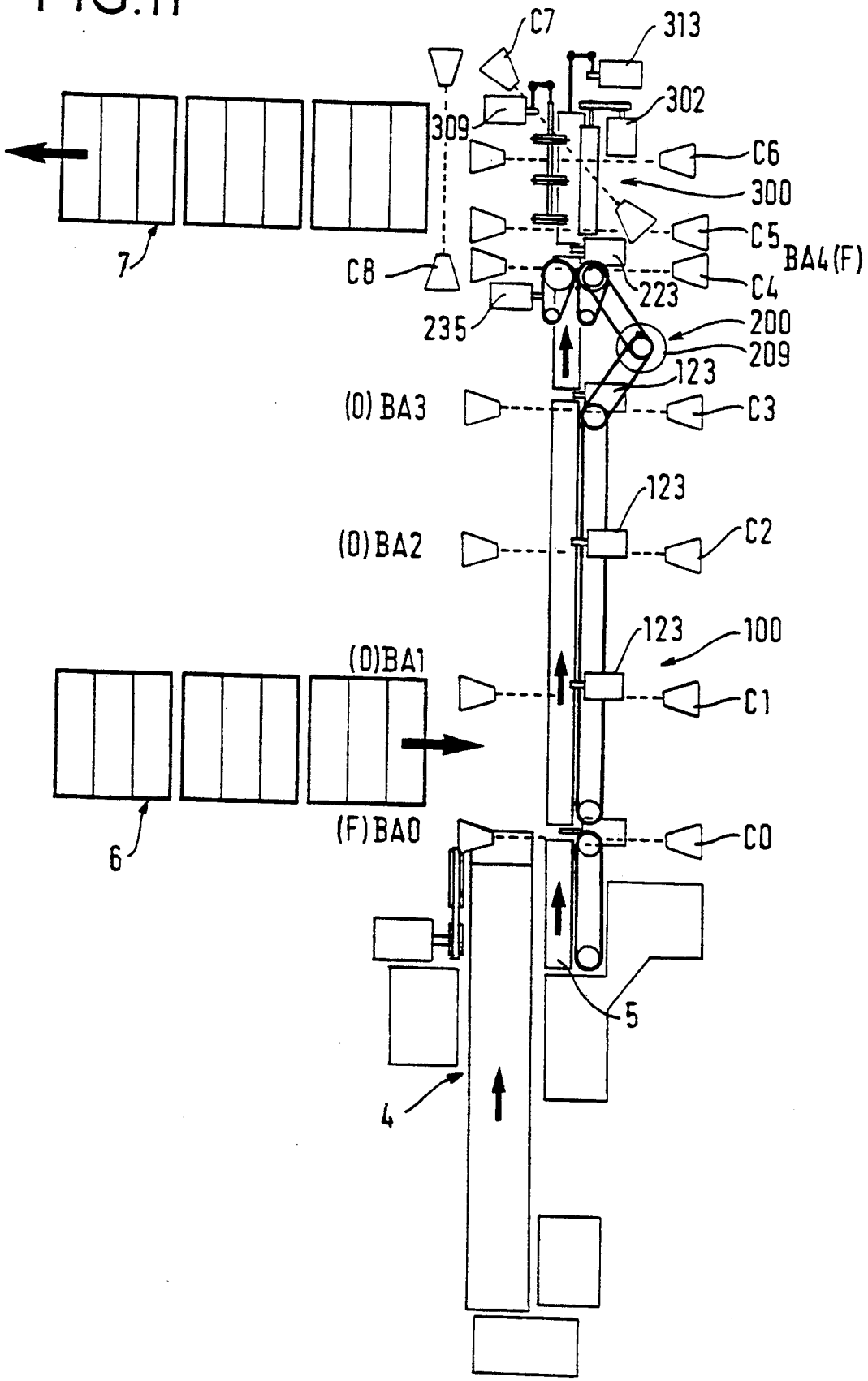
FIG. 11 is a schematic top view of the device fitted in a sorting machine.

The method of operating the feed device described above will now be detailed with reference to FIG. 11. The latter is a schematic view from above of the device fitted in a sorting machine.

An input feeder 4 is arranged perpendicular to the carousel with vertical pockets 6, 7. It is connected to the device by an auxiliary conveyor 5 provided with a stop gate BA0 and a sensor C0, such as a photoelectric cell.

Sensors C1 to C3 are likewise located near to the stop gates BA1 to BA3.

The gate BA0 is normally closed, the gates BA1, BA2, BA3 normally open.

In the presence of a flat object, in particular a letter in abutment with the gate BA0, detected by the detector C0, this gate is opened and the letter is transferred towards the accelerator module.

If other objects are fed before this letter is cleared from the accelerator module, the gates BA3, then BA2, then BA1 are closed.

This is an important function of the conveyor module. Each input feeder should cater for irregularity in the determination of the post code of the mail when this is effected by an operator, whether the presentation of the letters is effected by the operator or by an automatic device singling from a stack. This irregularity which characterizes the input flow of the objects requires the interposition of means making it possible to form a buffer store of objects before their transfer to the carousel operating with steady movement.

For input feeders equipped with an automatic recognition and indexing system, the residual irregularity is at the device singling from a stack, for which the rate of two objects per second is a mean value subject to fluctuation, which makes the presence of a buffer store advantageous.

Finally, when the part of the conveyor near the input feeders is occasionally full up for a short time, the existence of a buffer store allows the operators to recover from this saturation.

Once the object arrives at the accelerator module, it object is stopped by the gate BA4 which is normally closed. The method of operation is then as follows:

The sensor C4 detects a letter in the accelerator module and authorizes opening of the gate BA4 if the sensor C6 is not occluded, operating the electromagnet 235 and giving the command to close the gate BA4 when it ceases to be occluded.

The sensor C5 detects the rear end of the object and authorizes the command for injection after a delay (by operating the electromagnets 309 and 313). It is necessary and sufficient for the cell C5 to cease to be occluded to authorize injection. If it has been reoccluded following a rebound, the command has already been given.

The sensor C6 detects the presence of a letter in the injecting module.

The sensor C7 detects the rear end of a letter in the injecting module and thus the transfer of the letter and then gives the authorization for returning to the initial condition of the injecting module. If the occlusion is too long (in relation to a delay time), a letter jam is detected and the sorting machine is stopped. If delay in occlusion is detected (it can detect the front end of the letter), the information that the object has been slowed down is provided. If the occlusion occurs at the wrong time, a false direction is detected.

The sensor C8 in the path of the pockets allows synchronization and detects the correct position of the pocket for feeding thereto.

By way of example, for a carousel carrying a flow of six objects per second, the period T of passage of a pocket below the injecting module is substantially equal to 0.166 seconds. The objects should be transferred into the injecting module at a maximum rate compatible with their insertion into the pockets. This transfer should thus be effected with a period equal to T or a multiple of T.

Accordingly, if all the successive pockets are fed by the same input, this should ensure a feed period of 166 ms. If one pocket in two is fed by the input, the feed period is 333 ms and it is 500 ms if one pocket in three is fed.

This latter rate of two objects per second has been retained especially to ensure reliable injection, long life and a satisfactory sound level. The cycle of 500 ms starts from the instant of giving the command for the pulse which will impel the object present in the accelerator module and ends at the instant when its complete exit from the injecting module is detected. The following object can then be authorized to enter the injecting module.

Upstream of the accelerator module the movement of the objects takes place at the speed of 1.3 m/s. This value is a compromise ensuring their correct behavior and the rate of 2 objects/s.

For entry into the injecting module, two solutions can be provided:

When the injecting module is free, entry is effected by the pulse developed from the already moving object (stop gate retracted at the output of the accelerator module).

When the injecting module is occupied by the preceding object, the object to be transferred is temporarily halted by the stop gate BA4 at the output of the accelerator module, then being impelled at the moment when it is retracted.

To avoid a supplementary cause of deviation from the principle of movement of the objects, the same conditions of bringing up to speed are applied to all the objects.

The solution according to which they are accelerated from an initial state of rest imposed by closure of the stop gate BA4 has thus been retained.

In order that the transfer the object into the injecting module shall be satisfactory regardless of its type (within the range of mail to be processed), the transfer and acceleration means of the accelerator module are operated at a speed of 1.8 m/s. This speed ensures complete entry into the injecting module, possible rebounds being absorbed for example by a shock absorber hit by the front edge of the object.

The instant of arrival of the bottom edge at the level of the entrance to a pocket is delayed relative to the instant of the command for injection because of:

the response time following the injection command (opening the blocking shutter and setting the pressure means of the injecting module in operation), the time of passage of the 50 mm approximately which separates the lower edge of the injecting module and the entrance edge of the pocket.

This time is variable since it depends on the mass of the object, which increases the injection time the higher it is.

The injection order should thus be given when the destination pocket has not yet arrived in line with the injecting module. This distance should be such that the most rapid object does not strike the leading face of the pocket (in the sense of movement).

However it should also be such that the slowest and thickest object (in general the heaviest) can still enter the pocket and that, this being realized, rubbing of the object on the inner face of the rear wall of the pocket only takes place over a small fraction of its height.

The delay experienced by a heavy object relative to a light object leads to the result that, for the maximum thickness, the filling of the pocket should have been effected while it moves around 35 mm, namely during an interval of around 85 ms.

An injection speed of 3.8 m/s meets this requirement knowing that an object covers a distance on the order of 250 mm at this speed, corresponding to the maximum height of the objects to be processed.

The speed of 1.8 m/s imparted by the accelerator module and the speed of 3.8 m/s imparted by the injecting module comply with a cycle of 500 ms.

We claim:

1. A feed device for feeding a sorting machine for sorting flat objects and including at least one input feeder for the objects and pockets to which the objects are fed vertically for transport and discharge into output containers, the feed device allowing the objects to be conveyed one by one from the input feeder towards a vertical pocket and comprising a conveyor module substantially perpendicular to the path of the pockets and associated with a vertically downwards transfer device for transferring the objects into the pockets, wherein:

the conveyor module comprises at least two stop gates spaced by a distance greater than the maximum length of the objects;

an accelerator module is located between the conveyor module and the vertical downwards transfer device and comprises a downstream stop gate;

the vertical downwards transfer device is formed by an injecting module; and these modules being provided with continuously operating positive entrainment devices and the stop gates being retractable and controlling the movements of the objects in response to detectors located in the path of the objects.

2. A device according to claim 1, wherein the three modules are in line and comprise a backing surface for objects inclined relative to the vertical plane.

3. A device according to claim 2, wherein each stop gate is formed by a retractable pin passing through the backing surface in operative position and being fixed to a lever pivoting about a horizontal axis and actuated by an electromagnet.

4. A device according to claim 2, wherein the conveyor module and the accelerator module comprise a support surface perpendicular to the backing surface.

5. A device according to claim 4, wherein the backing surface and the support surface of the conveyor module are provided with continuously operating conveyor belts.

6. A device according to claim 5, wherein the conveyor module is provided with a freely rotating pressure wheel near to each stop gate and mounted at the end of a lever pivoting wheel about an axis perpendicular to the support surface and biased by a spring.

7. A device according to claim 4, wherein the accelerator module includes transfer means and accelerating means pivoting between a rest position and an active position in which the object is held between these two means, which are rotated continuously.

8. A device according to claim 7, wherein the transfer means is formed by at least one pair of pulleys mounted respectively on two shafts parallel to the backing surface, at least one endless belt being fitted on the pulleys.

9. A device according to claim 7, wherein the accelerating means is formed by at least one endless belt in tension over at least one pair of pulleys mounted on two shafts which are fixed together and of which one is pivoted and actuated by an electromagnet.

10. A device according to claim 2, wherein the injecting module comprises transfer means acting downwards, tangentially with respect to the backing surface, pressure means pivoting about a horizontal axis and a retractable blocking shutter forming a support surface perpendicular to the backing surface.

11. A device according to claim 10, wherein the downwardly acting transfer means is formed by a continuously driven roller rotating about a horizontal axis.

12. A device according to claim 10, wherein the pressure means is formed by at least two wheels rotating freely about a horizontal shaft mounted on a frame which pivots about a horizontal axis and is actuated by an electromagnet.

13. A device according to claim 10, wherein the blocking shutter pivots about a horizontal axis and is operated by an electromagnet.

14. A method of operating a feed device according to claim 1, wherein photoelectric sensors are located in the path of the objects in order to control the movements thereof, and wherein:

the stop gates of the conveyor module are normally open and are closed when a letter arrives, if a letter is present and arrested at the following stop gate; and the stop gate of the accelerator module is normally closed and is opened after arrival of a letter if no letter is detected in the injecting module.

* * * * *